US005894932A

United States Patent [19]

Harding et al.

[11] Patent Number: 5,894,932

[45] Date of Patent: Apr. 20, 1999

[54] SUSPENSION PACKAGE

[75] Inventors: Jennifer R. Harding; Bruce W. Halbmaier; Tammy L. Stiles; Lewis C. Lofgren, all of Chicago, Ill.

[73] Assignee: ADE, Inc., Chicago, Ill.

[21] Appl. No.: 08/874,022

[22] Filed: Jun. 12, 1997

[51] Int. Cl.[6] ..... B65D 81/07

[52] U.S. Cl. ..... 206/583; 206/594

[58] Field of Search ..... 206/305, 320, 206/521, 583, 591, 594

[56] References Cited

U.S. PATENT DOCUMENTS

| | | | |
|---|---|---|---|
| 4,606,459 | 8/1986 | Luray . | |
| 4,903,827 | 2/1990 | Phelps et al. | 206/583 |
| 4,923,065 | 5/1990 | Ridgeway . | |
| 5,056,665 | 10/1991 | Boecker et al. . | |
| 5,218,510 | 6/1993 | Bradford | 206/583 |
| 5,226,542 | 7/1993 | Boecker et al. . | |
| 5,323,896 | 6/1994 | Jones . | |
| 5,388,701 | 2/1995 | Ridgeway | 206/583 |
| 5,579,917 | 12/1996 | Lofgren et al. . | |
| 5,669,506 | 9/1997 | Lofgren et al. | 206/583 |
| 5,678,695 | 10/1997 | Ridgeway et al. | 206/583 |
| 5,738,218 | 4/1998 | Gonzales | 206/583 |

FOREIGN PATENT DOCUMENTS

| | | | |
|---|---|---|---|
| 1425746 | 2/1976 | United Kingdom | 206/583 |

*Primary Examiner*—Paul T. Sewell
*Assistant Examiner*—Luan K. Bui
*Attorney, Agent, or Firm*—Brinks Hofer Gilson & Lione

[57] ABSTRACT

A suspension package includes a frame having two sides and two ends positioned around a central opening. Two end panels are hinged at respective ends of the frame, and two side panels are hinged at respective sides of the frame. A product restraining hammock is mounted to extend between the end panels over the opening. In use the end panels are pivoted downwardly to tension the hammock and to suspend a product in the opening. The side panels are pivoted upwardly to space the frame array away from an outer container into which the suspension package is placed. The end panels may be shaped as tubular beams to provide increased bending resistance.

20 Claims, 4 Drawing Sheets

SUSPENSION PACKAGE

BACKGROUND OF THE INVENTION

This invention relates to a suspension package that suspends a product within a container.

A variety of suspension packages have been proposed in the past, including those described in U.S. Pat. Nos. 4,606,459, 5,056,665, 5,226,542, and 5,579,917, all assigned to the assignee of the present invention. Other suspension packages of the prior art are described for example in Ridgeway, U.S. Pat. No. 4,923,065.

In spite of this previous work, a need presently exists for an improved suspension package that is simpler and less expensive than the prior art packages described above.

SUMMARY OF THE INVENTION

The scope of the present invention is defined by the following claims, and nothing in this summary is intended to limit those claims. A first suspension package described below includes one or more frame elements that interconnect two end panels and two side panels. The end panels are positioned at respective ends of a central opening, and the side panels are positioned at respective sides of the central opening. A product restraint such as a hammock is mounted between the end panels to extend over the opening. The end panels are pivotable toward a first face of the frame elements to tension the product restraint and to suspend a product in the product restraint in the opening. The side panels are pivotable toward a second face of the frame elements (opposed to the first face) to space the second face away from an outer container. The suspension package described below is particularly inexpensive to manufacture and light in weight.

Other suspension packages described below include tubular beams that are pivotably mounted to the frame to extend between the sides of the frame. A product restraint is secured to the tubular beam such that pivoting motion of the tubular beam operates to selectively tension the product restraint.

DETAILED DESCRIPTION OF THE PRESENTLY PREFERRED EMBODIMENTS

Figure 1:
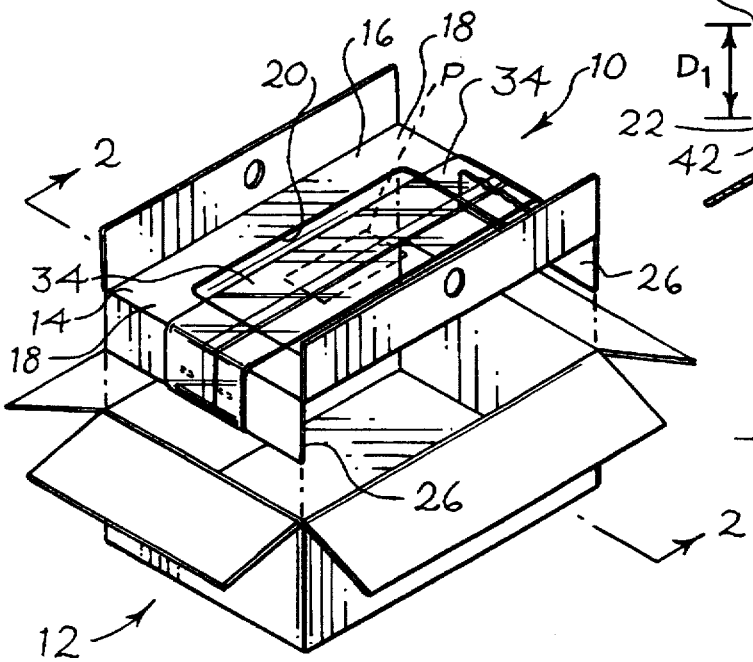
FIG. 1 is an exploded perspective view of a suspension package that incorporates a preferred embodiment of the present invention.

Turning now to the drawings, FIG. 1 shows an overall view of a suspension package 10 that incorporates a preferred embodiment of this invention. In FIG. 1 the suspension package 10 is shown in relation to an outer container 12.

Figure 2:
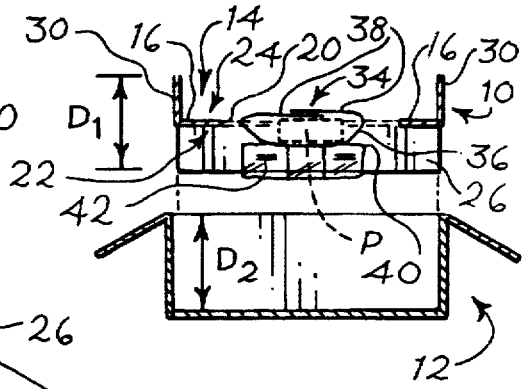
FIG. 2 is a cross-sectional view taken along line 2—2 of FIG. 1.
Figure 3:
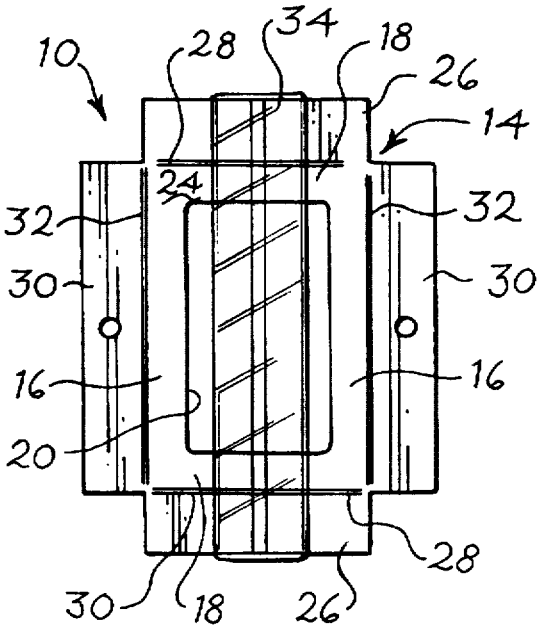
FIG. 3 is a plan view showing the suspension package of FIG. 1 from a top side, wherein all elements of the suspension package have been placed in a single plane.

As best shown in FIGS. 1 and 3, the suspension package 10 includes a rectangular frame 14 made up of two spaced, parallel, coplanar sides 16 interconnected by two spaced, parallel, coplanar ends 18. The sides 16 and the ends 18 extend around a central opening 20. As best shown in FIG. 2, this frame 14 defines a first face 22 and an opposed second face 24.

Returning to FIG. 3, two end panels 26 are connected to the frame 14 at respective fold lines 28. Each of the end panels 26 is connected to a respective one of the ends 18 on a respective side of the central opening 20. Similarly, two side panels 30 are connected at fold lines 32 to respective sides 16 of the frame 14.

Figure 4:
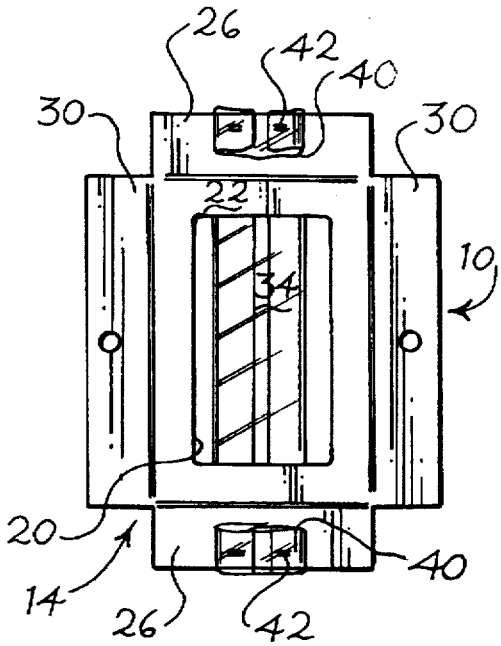
FIG. 4 is a plan view corresponding to FIG. 3 of the bottom side of the suspension package of FIG. 1.

As best shown in FIGS. 3 and 4, a product restraint such as a hammock 34 is connected to extend between the end panels 26 over the opening 20. The hammock 34 includes two ends 40 as shown in FIG. 4 that are fixed in place to the respective end panels 26 by staples 42 or other suitable means. As best shown in FIG. 2, the hammock 34 includes a lower sheet 36 which is joined along its lateral edges to two overlapping upper sheets 38. In this preferred embodiment the frame 14 and the panels 26, 30 are formed from a single sheet of material such as corrugated paperboard, and the fold lines 28, 32 are formed as scored lines.

In use, a product P being packaged is inserted into the hammock 34 between the lower sheet 36 and the upper sheets 38, as shown in FIG. 2. Then the end panels 26 are folded downwardly, toward the first face 22 until they are substantially perpendicular to the first face 22. This movement of the end flaps 26 tensions the hammock 34 and suspends the product P in place in the opening 20. Note that the product P is spaced from all parts of the suspension package 10 except for the hammock 34. Similarly, the side panels 30 are folded upwardly toward the second face 24 until the side panels 30 are substantially perpendicular to the frame 14, as shown in FIG. 2.

Once the product P has been loaded into the hammock 34 and the end panels 26 and side panels 30 have been folded as described above and shown in FIG. 2, the suspension package 10 is then placed within the outer container 12 of FIG. 1. Preferably, the suspension package 10 is dimensioned such that the walls of the outer container 12 prevent the end panels 26 from rotating away from the perpendicular orientation, thereby maintaining tension on the hammock 34. In addition to tensioning the hammock 34, the end panels 26 cooperate with the side panels 30 to space the frame 14 away from the top and bottom of the outer container 12. In particular, note that the height D2 of the interior of the container 12 is substantially equal to the height D1 of the suspension package 10 as measured between the top of the side panels 30 and the bottom of the end panels 26 (FIG. 2). Once the outer container 12 is closed, the end panels 26 cooperate with the side panels 30 and the frame 14 to substantially immobilize the suspension package 10 in a centered position within the outer container 12. Accelerations associated with transport and storage that are imposed on the outer container 12 are to a great extent isolated from the product P by the hammock 34.

Simply by way of example, both the outer container 12 and the major portions of the suspension package 10 including the frame 14, the end panels 26 and the side panels 30 may be formed from corrugated paperboard. The hammock 34 may be formed of a resilient elastomeric material such as polyurethane. The upper sheets 38 may be formed integrally with the lower sheet 36, and an opening may be left between the overlapping portions of the upper sheets 38 to allow the product P to be inserted and removed.

Figure 5:
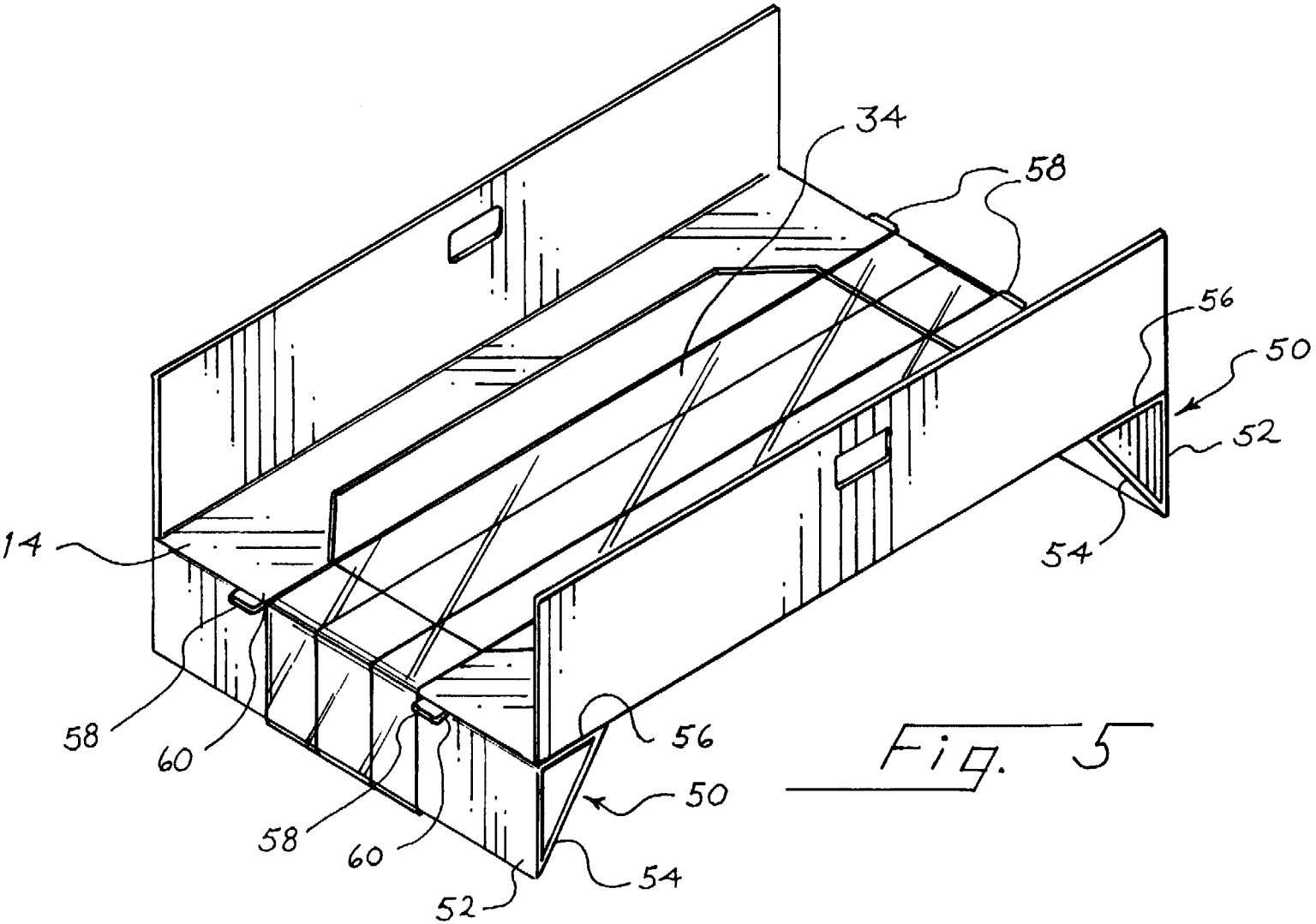
FIG. 5 is a perspective view of a second preferred embodiment of the suspension package of this invention.

FIG. 5 shows a perspective view of a second preferred embodiment of this invention that is similar to the suspension package 10 described above. In the embodiment of FIG. 5 the end panels are shaped to form tubular beams 50 made up of three panels 52, 54, 56 interconnected by fold lines. Each panel 56 forms at its free end a pair of locking tabs 58, each positioned to fit into a respective slot 60 adjacent the junction between the panel 52 and the frame 14. The other components of the suspension package of FIG. 5 can be identical to corresponding components of the embodiment of FIGS. 1–4.

The tubular beam 50 provides several advantages. First, because it is shaped as a tube with an open space therein, the tubular beam 50 is particularly rigid, and is well suited to support substantial bending loads imposed on the tubular beam 50 by the hammock 34. Second, the tubular beam 50 forms an effective spacer tending to center the frame 14 within an outer container (not shown in FIG. 5). Because the tabs 58 cooperate with the slots 60 to releasably hold the panels 52, 54, 56 in the geometry of a tubular beam 50, the entire assembly can readily be placed in a flat, planar condition for shipping and storage. As in the embodiment of FIGS. 1–4, the entire suspension package shown in FIG. 5 can be formed from one sheet of folded corrugated paperboard, to which the hammock is attached.

In the embodiment of FIG. 5 the tubular beam 50 is triangular in cross section. Of course, other tubular cross-sectional shapes can be used, including square, rectangular and other shapes.

Figure 6:
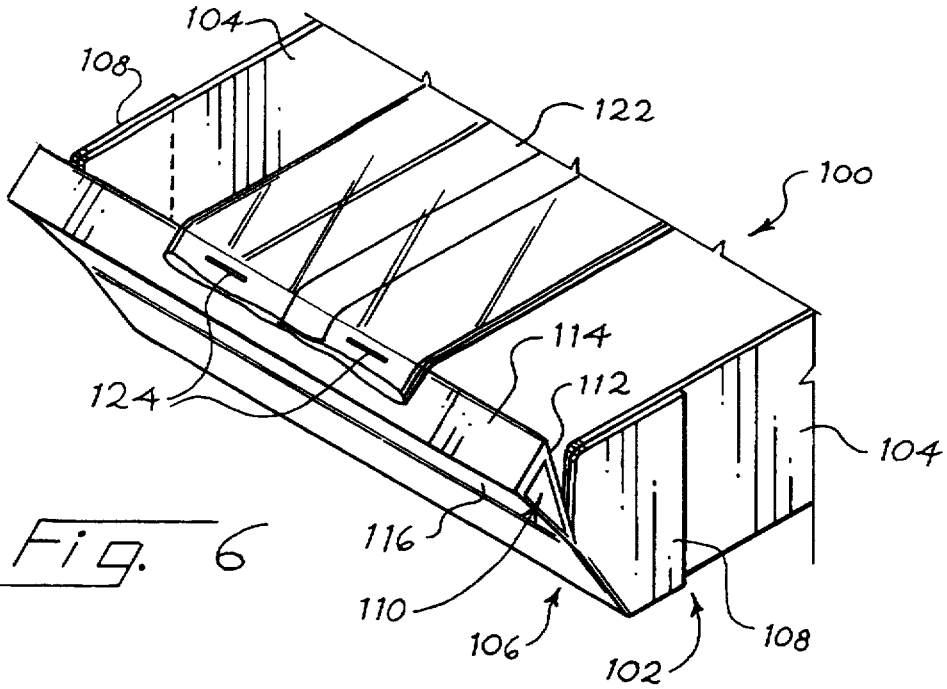
FIG. 6 is a perspective view of a portion of a third preferred embodiment of the suspension package of this invention.

The tubular beam discussed above in conjunction with FIG. 5 can also be used with other types of suspension packages. As shown for example in FIGS. 6–8, tubular beams can be used in a suspension package 100 comprising a frame 102 that includes two side panels 104 and two end panels 106. The end panels 106 are integrally formed with glue panels 108 that are glued to the side panels 104 to form a rectangular frame. The end panels 106 are also integrally formed with panels 112, 114, 116, which can be folded to form a tubular beam 110 at each end of the suspension package 100. In FIG. 6 only half of the suspension package 100 is shown, but FIGS. 7 and 8 provide cross-sectional views illustrating the entire package.

Figure 7:
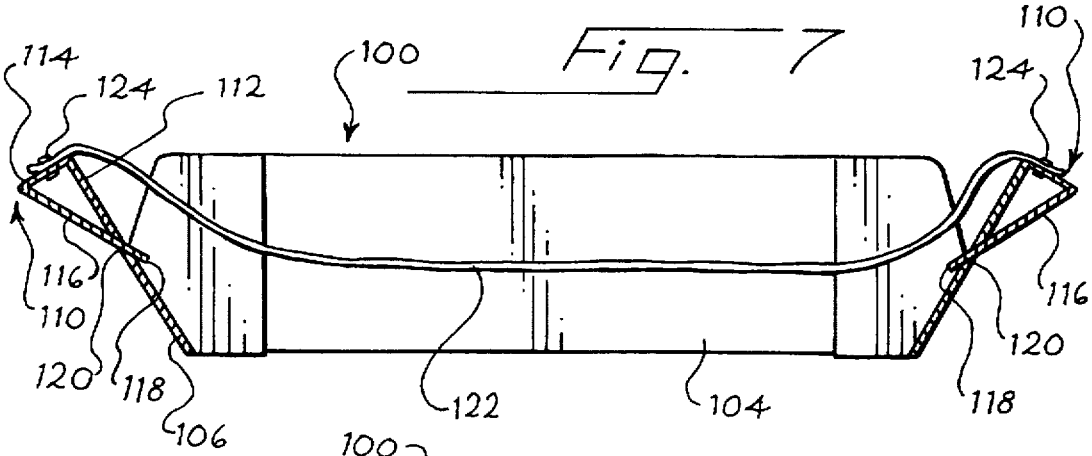
FIG. 7 is a cross-sectional view of the embodiment of FIG. 6, showing the hammock in an untensioned state.
Figure 8:
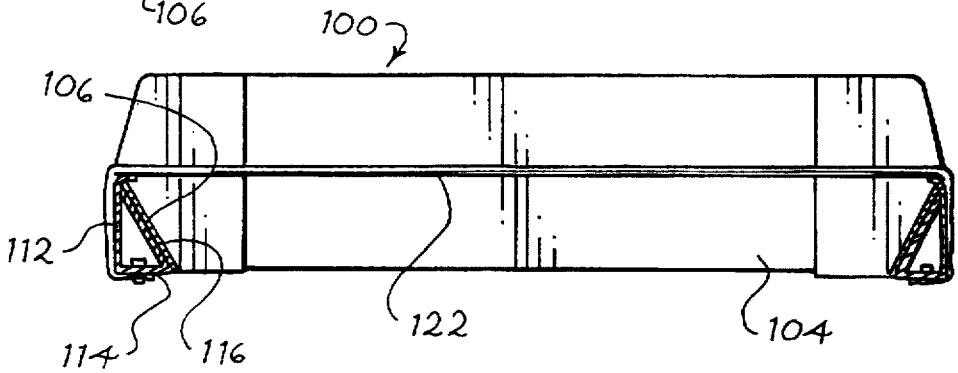
FIG. 8 is a cross-sectional view corresponding to FIG. 7, showing the hammock in a tensioned state.

As best shown in FIG. 7, the panels 116 define locking tabs 118 that are positioned to engage slots 120 near the fold line that interconnects the panel 112 with the end panel 106. A product restraint such as a hammock 122 is secured to the tubular beam 110, as for example with staples 124.

FIG. 7 shows the suspension package 100 with the hammock in an untensioned position, in which the tubular beams 110 have been rotated inwardly. As shown in FIG. 8, when the tubular beams are rotated outwardly, until the panels 116 move into a position substantially parallel to the end panels 106, the hammock is tensioned for use. Note that the end panels 106 are positioned obliquely with respect to the sides such that, when the tubular beams 110 are in the outwardly rotated position of FIG. 8, the panels 112 are substantially perpendicular to the top and bottom of the sides 104. In this way, a flat, flush end is provided to the suspension package 100 when the hammock 122 is tensioned.

Preferably, the length of the tubular beams 110 is sufficiently wider than the outside width between the side panels 104 to ensure that transverse loads applied to the tubular beams 110 by the hammock 122 are reliably applied to the side panels 104.

Because the tubular beams 110 are held in configuration by a removable tab 118 and slot 120, the entire suspension package 100 can be fully collapsed when not in use. If collapsibility is not desired, the panels 112, 114, 116 can be glued permanently into a tubular configuration. Similarly, if it is not necessary that a flat, flush end be provided to the suspension package 100, the tubular beam 110 can be used with conventional, vertically oriented end panels on the frame 102. In this case, the tubular beam can be glued to a pivotable flap included on the end panel. As before, the tubular beams can take many cross-sectional shapes, including rectangular and other shapes. If desired, the tubular beam may be separately formed of any suitable material, and then pivotably mounted to the frame.

Figure 9:
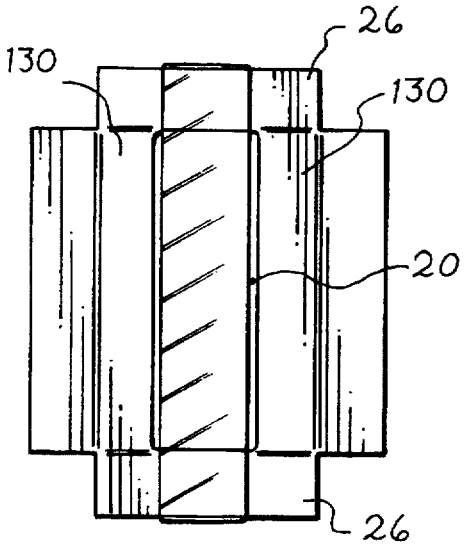
FIGS. 9 and 10 are plan views of two additional embodiments.
Figure 10:
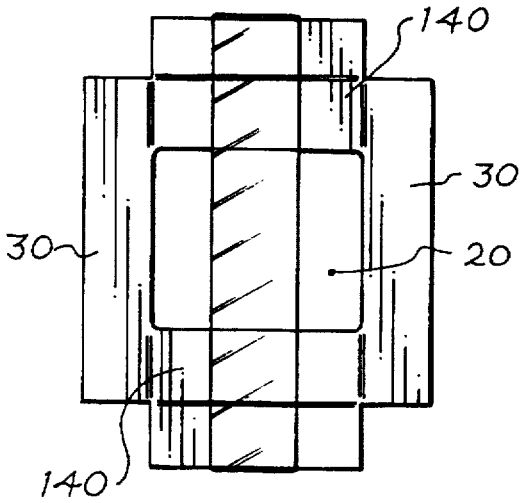

Of course, many alternatives are possible to the preferred embodiments described above. For example, not all embodiments of the suspension package of this invention require the use of a frame as shown. In alternative embodiments the frame can be replaced with one or more frame elements that provide the desired structural integrity. For example, the frame 14 may be replaced with two beams 130 extending between the end panels 26 on opposite sides of the central opening 20 (FIG. 9). Alternatively, the frame 14 can be replaced with two beams 140 extending between the side panels 30 on opposite sides of the central opening 20 (FIG. 10). In yet another alternative the frame 14 can be replaced with a plurality of frame elements that interconnect adjacent corners of the end panels 26 and side panels 30.

Depending on the application, the central opening 20 may take many shapes. For example, round, oval or octagonal openings may be used in any suitable size. In some applications the central opening may include or be limited to one or more slits that allow portions of the frame adjacent the slits to move away from the product as the product restraints are tightened. For example, an array of radially extending slits may be used to form the opening. As yet another variant, the central opening may be eliminated and all of the hammock 34 may extend on one side of the frame 14. In this case the hammock is interposed between the product and the frame, thereby protecting the product from abrasion against the frame.

Also, many materials and configurations can be adapted for use with this invention. For example the frame, frame beams, or frame elements may be formed of other materials such as plastic materials or metals. Also, in some embodiments it may be preferable to form the end panels 26 and the side panels 30 from separate parts which are pivotably mounted to the frame elements.

Furthermore, this invention is not limited to use with hammocks of the type shown in the figures. Other types of product restraints can be used, including other types of hammocks, and product restraints which rely on a cinching action as described for example in U.S. patent application Ser. No. 08/859,535, filed May 20, 1997 assigned to the assignee of the present invention. Some such product restraints include multiple C-shaped elements that encircle the product being suspended and hold the product in place by opposed forces on the end panels of the product. Other suitable product restraints include side support restraints that extend between the end panels and engage the product on the side surfaces of the product.

The foregoing detailed description has described only a few of the many forms that the present invention can take. The invention itself is defined only by the following claims, including all equivalents.

We claim:

1. A suspension package comprising:

two end panels;

two side panels;

at least one frame element interconnecting each of the end panels with both of the side panels, said at least one frame element comprising first and second opposed faces and defining an opening;

a product restraint mounted between the end panels and comprising upper and lower portions adapted to receive a product therebetween;

said end panels pivoted toward the first face to tension the product restraint and to suspend the product received between the upper and lower portions in the opening;

said side panels pivoted toward the second face to space the second face.

2. The invention of claim 1 wherein the at least one frame element comprises:

a frame forming the opening and comprising two opposed sides on respective sides of the opening and two opposed ends on respective ends of the opening;

wherein the end panels are each positioned at a respective end of the frame; and wherein the side panels are each positioned at a respective side of the frame.

3. The invention of claim 2 wherein the frame, the end panels and the side panels are formed in one piece from a single sheet of material.

4. The invention of claim 3 wherein the sheet of material comprises paperboard.

5. The invention of claim 1 wherein the at least one frame element comprises a pair of spaced, substantially coplanar, substantially parallel beams disposed on respective sides of the product restraint, said beams comprising respective ends; and wherein the end panels are positioned to bridge the beams at respective ends of the beams.

6. The invention of claim 1 wherein the at least one frame element comprises a pair of spaced, substantially coplanar, substantially parallel beams, said beams comprising respective ends; and wherein the side panels are positioned to bridge the beams at respective ends of the beams.

7. The invention of claim 1 wherein the product restraint comprises a hammock, wherein the lower portion comprises a lower sheet, wherein the upper portion comprises two overlapping upper sheets, and wherein the hammock is adapted to receive the product between the upper and lower sheets.

8. The invention of claim 1 in combination with an outer container, wherein the end panels are positioned substantially at right angles to the first face to space the first face away from the outer container.

9. The invention of claim 8 wherein the side panels are positioned substantially at right angles to the second face.

10. The invention of claim 2 wherein the frame extends completely around the opening.

11. The invention of claim 10 wherein the end panels and the side panels are each connected to the frame at a respective fold line.

12. The invention of claim 1 wherein the end panels each comprise a respective tubular beam which is pivotable with respect to the at least one frame element about a pivot axis situated substantially at an edge of the tubular beam.

13. The invention of claim 12 wherein the tubular beams are each triangular in cross section.

14. The invention of claim 3 wherein the end panels each comprise a respective tubular beam.

15. A suspension package comprising:

two end panels;

two side panels;

a frame interconnecting the end panels and the side panels and positioned in a central plane, said frame comprising an opening in the central plane and first and second opposed faces;

a hammock mounted between the end panels to extend over the frame to suspend a product in the opening, said hammock comprising upper and lower sheets, said upper and lower sheets both positioned alongside the second face of the frame;

said end panels pivoted toward the first face to tension the hammock such that the end panels are substantially entirely positioned on a first side of the central plane;

said side panels pivoted toward the second face to space the second face such that the side panels are substantially entirely positioned on a second side of the central plane, opposed to the first side.

16. The invention of claim 15 wherein each of the tubular beams pivots about a respective pivot axis with respect to the frame, and wherein each pivot axis is situated at an edge of the respective tubular beam.

17. A suspension package comprising:

a frame comprising two opposed sides;

first and second tubular beams, each beam mounted to the frame to extend between the sides to pivot with respect to the frame about a respective pivot axis, said axes spaced apart from one another and positioned at edges of the respective tubular beams; and a product restraint secured to the tubular beams and extending to an interior portion of the frame such that pivoting motion of the tubular beams operates to selectively tension the product restraint.

18. The invention of claim 17 wherein the tubular beams are triangular in cross section.

19. The invention of claim 17 wherein the frame comprises an end wall mounted between the sides, wherein the end wall is obliquely oriented with respect to the sides to receive at least a portion of one of the tubular beams.

20. The invention of claim 19 wherein the beams are triangular in cross section.

* * * * *